US011844452B1

(12) United States Patent
Wu

(10) Patent No.: US 11,844,452 B1
(45) Date of Patent: Dec. 19, 2023

(54) MULTIFUNCTIONAL PILLOW

(71) Applicant: STEVEN MARKETING INTERNATIONAL, INC., Katy, TX (US)

(72) Inventor: Xiaoguang Wu, Katy, TX (US)

(73) Assignee: STEVEN MARKETING INTERNATIONAL, INC., Katy, TX (US)

( * ) Notice: Subject to any disclaimer, the term of this patent is extended or adjusted under 35 U.S.C. 154(b) by 0 days.

(21) Appl. No.: 18/180,845

(22) Filed: Mar. 9, 2023

(51) Int. Cl.

| | |
|---|---|
| ***A47G 9/10*** | (2006.01) |
| ***A47C 7/38*** | (2006.01) |
| ***A45F 4/02*** | (2006.01) |
| ***A45F 3/00*** | (2006.01) |

(52) U.S. Cl.
CPC ..... *A47G 9/1045* (2013.01); *A47C 7/383* (2013.01); *A45F 3/005* (2013.01); *A45F 4/02* (2013.01); *A47G 2009/1018* (2013.01)

(58) Field of Classification Search
CPC ... A47C 7/383; A47C 1/146; A45F 2004/023; A45F 2004/026; A45F 3/005; A45F 4/06; A47G 9/062; A47G 9/1045
See application file for complete search history.

(56) References Cited

U.S. PATENT DOCUMENTS 1,222,563 A * 4/1917 Rosenberg ..... A47G 9/062 5/419
1,256,783 A * 2/1918 Fuller ..... A47G 9/062 5/419
2,038,335 A * 4/1936 Aronow ..... A47G 9/1045 5/419
2,183,418 A * 12/1939 Williams ..... A47G 9/1045 5/636
2,792,576 A * 5/1957 Coady ..... A45F 4/02 5/636
2,986,202 A * 5/1961 Yates ..... A47C 7/383 297/188.05
3,011,173 A * 12/1961 Goetz ..... A47C 7/546 383/18
3,175,230 A * 3/1965 Herdal ..... A47G 9/1045 5/639
5,345,633 A * 9/1994 Harnish ..... B60N 2/879 5/639
5,503,456 A * 4/1996 Rossini ..... A47C 7/425 224/586
6,647,570 B1 * 11/2003 Ong ..... A47G 9/1045 5/502
7,111,343 B1 * 9/2006 Bates ..... A47G 9/1045 383/4
10,426,242 B1 * 10/2019 Little ..... A45F 3/005
(Continued)

*Primary Examiner* — Eric J Kurilla

(57) ABSTRACT

A multifunctional pillow includes a flexible pillowcase having a first end, an opposite second end, two opposing sides, a top face and a bottom face; a pillow body provided inside the pillowcase, the pillow body being made of a soft material; and a storage bag attached to and provided at the second end of the pillowcase. The pillow is rollable from the first end towards the second end, and the rolled up pillow is insertable into the storage bag, which is sized and shaped to fittingly hold the rolled up pillow. The storage bag can be a flexible bag or a pocket. The multifunctional pillow can be configured into a waist pillow, a wrist rest pillow, or a neck pillow configuration.

18 Claims, 7 Drawing Sheets

(56) References Cited

U.S. PATENT DOCUMENTS

| | | | | |
|---|---|---|---|---|
| 10,918,229 | B1 * | 2/2021 | Mello | A47G 9/04 |
| 10,973,345 | B1 * | 4/2021 | Kirk | A47C 16/00 |
| 11,039,691 | B2 * | 6/2021 | Porter | A47C 7/425 |
| 11,109,698 | B1 * | 9/2021 | Ogden | A47G 9/0253 |
| 2004/0039316 | A1 * | 2/2004 | Smith | A47G 9/1009 602/6 |
| 2005/0155152 | A1 * | 7/2005 | Coats | A47C 7/383 5/636 |
| 2006/0179575 | A1 * | 8/2006 | Goodwin | A47D 13/025 5/655 |
| 2008/0034504 | A1 * | 2/2008 | Schmidt | A47G 9/10 5/636 |
| 2011/0017793 | A1 * | 1/2011 | Mellion | A47C 7/383 128/845 |
| 2012/0011655 | A1 * | 1/2012 | Rojas | A47C 7/383 5/636 |
| 2014/0000036 | A1 * | 1/2014 | Cohen | A47C 27/081 5/639 |
| 2014/0007351 | A1 * | 1/2014 | Cohen | A47G 9/0253 5/639 |
| 2016/0120253 | A1 * | 5/2016 | Schenk | A47C 7/383 2/173 |
| 2018/0028002 | A1 * | 2/2018 | Lou | A47G 9/1081 |
| 2018/0064269 | A1 * | 3/2018 | Carlile | A47G 9/0223 |
| 2018/0177312 | A1 * | 6/2018 | Reed-Williams | A47G 9/1045 |
| 2019/0008265 | A1 * | 1/2019 | Mitchell | A47G 9/1045 |
| 2020/0077820 | A1 * | 3/2020 | Lowry | A47G 9/1027 |
| 2020/0093294 | A1 * | 3/2020 | Ban | A47G 9/10 |
| 2020/0221888 | A1 * | 7/2020 | Cable | A47C 16/00 |
| 2021/0153670 | A1 * | 5/2021 | Maxfield | A47G 9/1045 |
| 2021/0244163 | A1 * | 8/2021 | Ware | A47G 9/0223 |
| 2021/0369019 | A1 * | 12/2021 | Ambuske | A47G 9/1045 |
| 2022/0087404 | A1 * | 3/2022 | Jacobs | A45F 3/005 |

* cited by examiner

MULTIFUNCTIONAL PILLOW

TECHNICAL FIELD

The present application relates to the technical field of pillows, and particularly relates to a multifunctional pillow.

BACKGROUND

Foamed plastic, as one of major varieties of polyurethane synthesis materials, is mainly characterized by porosity, therefore, the foamed plastic is relatively low in density and high in specific strength. In accordance with various adopted raw materials and change in formula, soft polyurethane foamed plastic, semi-hard polyurethane foamed plastic, hard polyurethane foamed plastic and the like can be made. A foamed pillow inner, on the basis of the characteristics of the soft polyurethane foamed plastic, is convenient to produce and good in softness.

While the foamed pillow inner has good elasticity, but it has large size and not convenient for storage, packaging and transportation. There is a need for a pillow that is easy to carry and store and has multiple functions.

SUMMARY OF THE INVENTION

According to one aspect, there is provided a multifunctional pillow including: a flexible pillowcase, the pillowcase having a first end, an opposite second end, two opposing sides, a top face and a bottom face; a pillow body provided inside the pillowcase, the pillow body being made of a soft material; and a storage bag attached to and provided at the second end of the pillowcase, wherein the pillow is rollable from the first end towards the second end, and the rolled up pillow is insertable into the storage bag, which is sized and shaped to fittingly hold the rolled up pillow.

In one embodiment, the multifunctional pillow may further include a first connector connected to the first end of the pillowcase; and a second connector connected to the second end of the pillowcase, the first connector being releasably fastenable to the second connector.

In one embodiment, the multifunctional pillow may further include a first connection part connected to the first end of the pillowcase; a second connection part connected to the second end of the pillowcase; a first connector connected to the first connection part; and a second connector connected to the second connection part, the first connector being releasably fastenable to the second connector.

In one embodiment, the storage bag may be in the form of a flexible bag. The second end of the pillow case is an open end, and the flexible bag is attached to the open end of the pillowcase and is sandwiched between the pillowcase and the pillow body when the flexible bag is not in use, and when in use, the rolled up pillow is inserted into the flexible bag after the flexible bag is pulled out from the pillowcase and turned inside-out, and formed into a waist pillow configuration.

In one embodiment, the flexible bag may include a first closing element that opens and closes an opening of the flexible bag.

In one embodiment, the pillowcase may include a second closing element that opens and closes the open end of the pillowcase.

In one embodiment, the storage bag may be in the form of a pocket. The pocket may be defined by a piece of fabric with periphery being attached on the top face of the pillowcase at the second end thereof, and formed a pocket opening facing the first end of the pillowcase and extending between the two opposing sides.

In one embodiment, the multifunctional pillow may further include a third connector provided on an inner surface of the piece of fabric proximate to the pocket opening, whereby the second connector is releasable fastenable to the third connector, after the rolled up pillow is inserted into the pocket.

In one embodiment, the pillow can be foldable along a longitudinal axis extending between the first end and the second end of the pillowcase to form a wrist rest pillow configuration.

In one embodiment, the folded pillow can be further bendable into a U-shape, and the first connector is releasably fastenable to the second connector to form a neck pillow configuration.

In one embodiment, one of the two opposing sides may be provided with a plurality of first fasteners, and another one of the two opposing sides may be provided with a plurality of second fasteners, the plurality of first fasteners is releasably fastenable to the plurality of second fasteners, so as to hold the pillow in a folded configuration.

In one embodiment, the multifunctional pillow may further include a protection sheet connected to the first end of the pillowcase, and covered one side of the first connector, thereby preventing the first and second connectors from direct contact with a user's skin when the pillow is in use.

In one embodiment, the multifunctional pillow may further include a strap having a proximal end connected to the second end of the pillowcase, and a distal end connected to a fourth connector, wherein the strap is adapted to wrap around the rolled up pillow, and the fourth connector is releasably fastened to the second connector, thereby holding the rolled up pillow in place.

In one embodiment, the releasably fastenable first and second connectors may include a fastening mechanism selected from a group consisting of a button, a buckle, and hook and loop straps.

In one embodiment, the soft material may include foam, chemical fiber, feather, silk, beads, or other suitable soft materials.

In one embodiment, the two opposing sides of the pillowcase may have an inwardly-curved arc shape.

In one embodiment, the storage bag may include a handle, and the handle may include a button, a buckle, or hook and loop straps.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Figure 1:
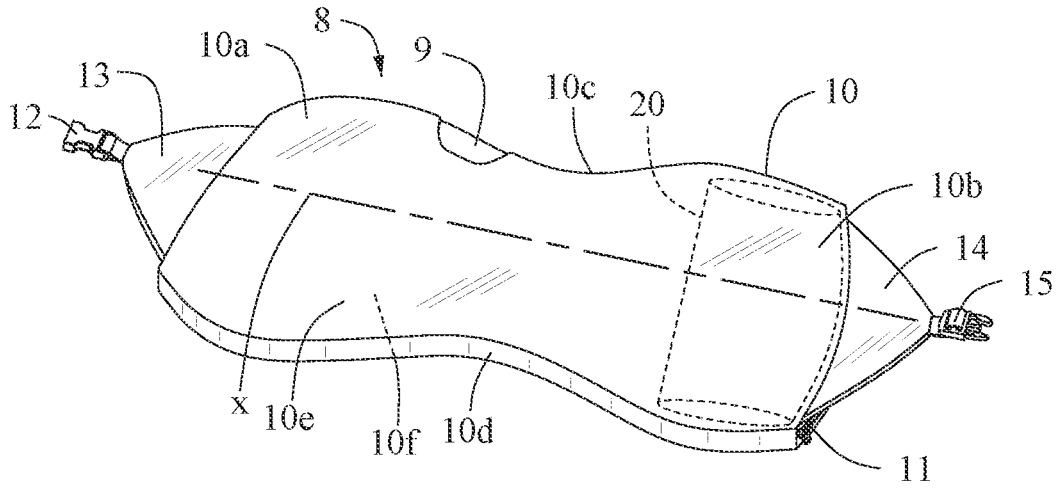
FIG. 1 shows a multifunctional pillow in an open position with buckle connectors and a storage bag in accordance with one embodiment of the present application, the storage bag being disposed inside the multifunctional pillow.

In the drawings, the reference numbers represent the followings: 8, pillow; 9, pillow body; 10, pillowcase; 10*a*, first end; 10*b*, second end; 10*c*, 10*d*, opposing sides; 10*e*, top face; 10*f*, bottom face; 11, second closing element; 12, 12', first connector; 13, first connection part; 14, second connection part; 15, 15', second connector; 17, third connector; 20, flexible bag; 20', pocket; 21, first closing element; 22, pocket opening; 23, handle; 24, handle connector; 25, protection sheet; 26, strap; 27, fourth connector; 28, fabric; 29, first fasteners; and 30, second fasteners.

DETAILED DESCRIPTION

Reference will now be made in detail to embodiments of the present invention, example of which is illustrated in the accompanying drawings.

The present invention provides a multifunctional pillow 8. As shown in FIG. 1, the multifunctional pillow 8 may include a soft pillow body 9, a flexible pillowcase 10, and a storage bag 20, 20'. The pillowcase 10 has a first end 10*a*, an opposite second end 10*b*, two opposing sides 10*c*, 10*d*, a top face 10*e*, and a bottom face 10*f*. The pillow body 9 is provided inside the pillowcase 10. The pillow body 9 may be made of a soft material. The soft material may include foam (e.g., polyurethane foam), chemical fiber, feather, silk, beads, or other suitable soft materials. As used herein, "soft material" includes resilient material, flexible material and pliable material that can allow the pillow body to be rolled up. The storage bag 20, 20' may be attached to and provided at the second end 10*b* of the pillowcase 10. The pillow 8 is rollable from the first end 10*a* towards the second end 10*b*, and the rolled up pillow is insertable into the storage bag 20, 20', which is sized and shaped to fittingly hold the rolled up pillow.

Figure 2:
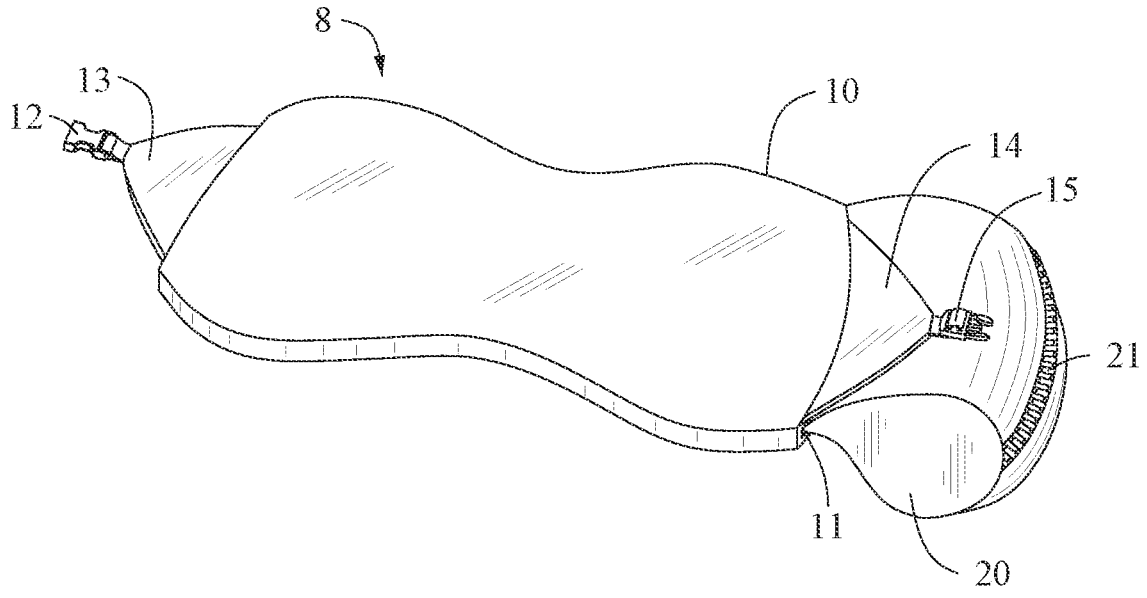
FIG. 2 shows the multifunctional pillow in the open position with the storage bag being disposed outside of the multifunctional pillow.
Figure 3:
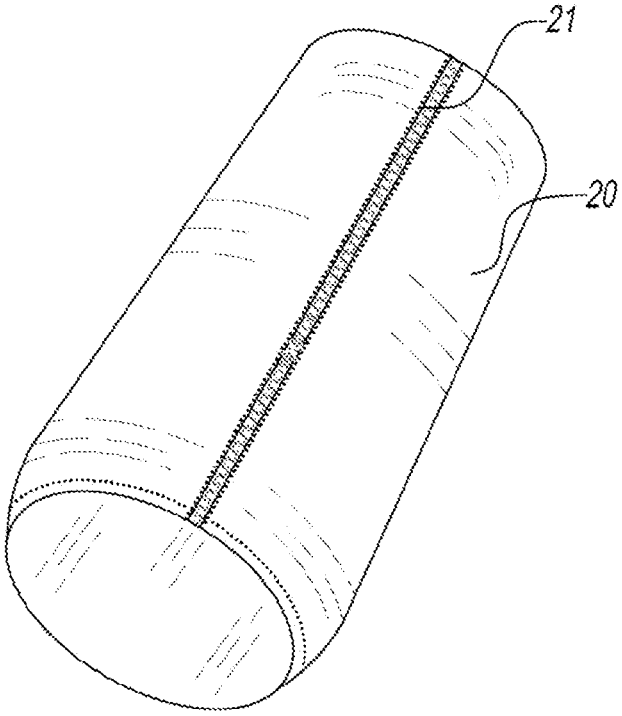
FIG. 3 shows the multifunctional pillow being stored in the storage bag in accordance with one embodiment of the present application.

In one embodiment, as shown in FIGS. 1-3, the second end 10*b* is an open end. The pillow body 9 can be inserted into the pillowcase 10 through this open end. The storage bag may be in the form of a flexible bag 20. The flexible bag 20 may be attached to the open end 10*b* of the pillowcase 10, and may be sandwiched between the pillowcase 10 and the pillow body 9 when the flexible bag 20 is not in use. When in use, the rolled up pillow can be inserted into the flexible bag 20 through an opening of the flexible bag, after the flexible bag 20 is pulled out from the pillowcase 10 and turned inside-out.

The pillow 8 may include a first connection part 13 connected to the first end 10*a* of the pillowcase 10, a second connection part 14 connected to the second end 10*b* of the pillowcase 10, a first connector 12 connected to the first connection part 13, and a second connector 15 connected to the second connection part 14. The first and second connection parts 13, 14 may have a triangular shape or another shape, and may be made of the same material or a similar material as the pillowcase 10.

The first connector 12 can be releasably fastened to the second connector 15. The first and second connectors 12, 15 may be in the form of a fastening mechanism such as a button, a buckle, or hook and loop straps. The hook and loop straps can be, for example, VELCRO (registered trademark) straps.

The flexible bag 20 includes a first closing element 21 (e.g., a zipper) for opening and closing the opening of the flexible bag 20. The pillowcase 10 includes a second closing element 11 (e.g., a zipper) for opening and closing the open end 10*b* of the pillowcase 10.

In use, the flexible bag 20 is initially attached inside the second end 10*b*. When the second closing element 11 is opened, a user can take the flexible bag 20 out, as shown in FIG. 2. The flexible bag 20 can be connected to the pillowcase 10 via the second closing element 11, or it can be detached from the pillowcase 10. The flexible bag 20 includes a first closing element 21. To store the pillow 8 in the flexible bag 20, a user will first open the first closing element 21, and then roll the pillow 8 starting from the first end 10*a*. The user will place the rolled up pillow 8 into the flexible bag 20 after the flexible bag is turned inside-out, and close the first closing element 21. As shown in FIG. 3. the flexible bag 20 with the rolled up pillow inside has a round column shape.

The flexible bag 20 may be made of a linen fabric or another suitable material. The linen fabric has a certain hardness so that the flexible bag 20 has a certain shape and hardness for holding the rolled up pillow 8. The rolled up pillow can also serve as a waist pillow.

The pillow 8 may have a peanut shape, as illustrated in FIGS. 1 and 2. The depth of the middle of the pillow is less than the depth of the first end 10*a* and the second end 10*b*. Preferably, the depth of the middle of the pillow is about 17-20 mm less than the depth of the first end 10*a* and the second end 10*b* of the pillow.

Figure 7:
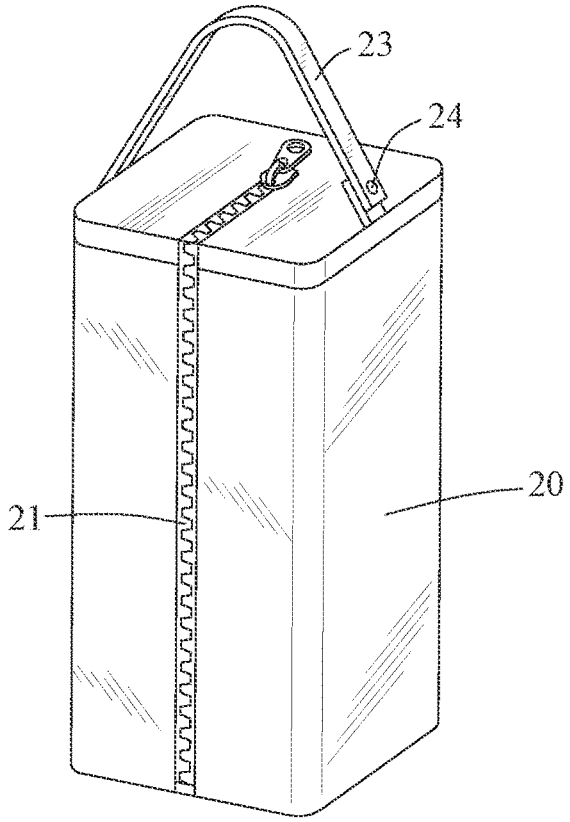
FIG. 7 shows the multifunctional pillow being stored in the storage bag in accordance with one embodiment of the present application, and the storage bag is provided with a handle.

As shown in FIG. 7, the flexible bag 20 can also have another shape, e.g., square column shape. In some embodiment, the flexible bag 20 can have a handle 23. The handle 23 can be a detachable handle that includes a handle connector 24. The handle connector 24 can include a button, a buckle, or hook and loop straps. As illustrated in FIG. 7, the handle connector 24 is in the form of a button. The handle connector 24 can be opened by a user and be attached to an objection, e.g., a bag, a backpack, or a luggage. The user then can close the handle connector 24 so that the flexible bag 20 can be securely attached to the object.

Figure 10:
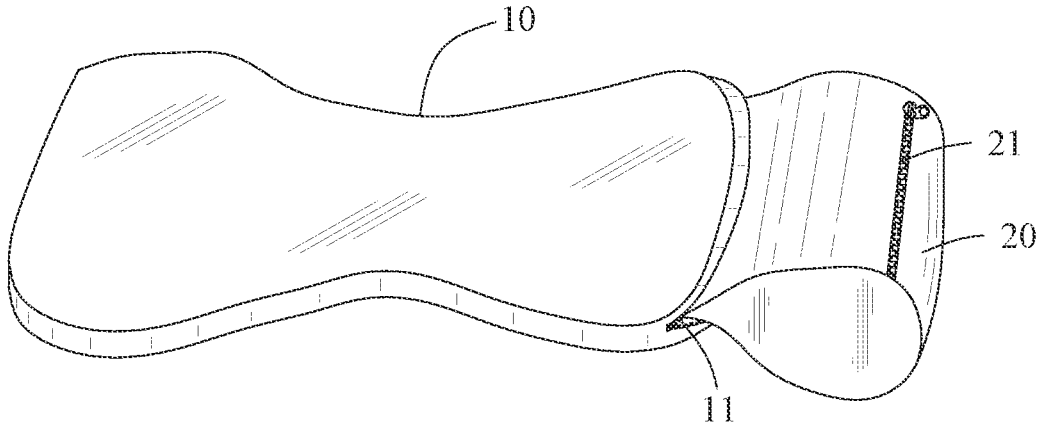
FIG. 10 shows the multifunctional pillow provided with a flexible bag according to an embodiment of the present application.

In yet another embodiment, as illustrated in FIG. 10, the pillow 8 is not provided with the first and second connection parts 13, 14, and the first and second connectors 12, 15.

Figure 4:
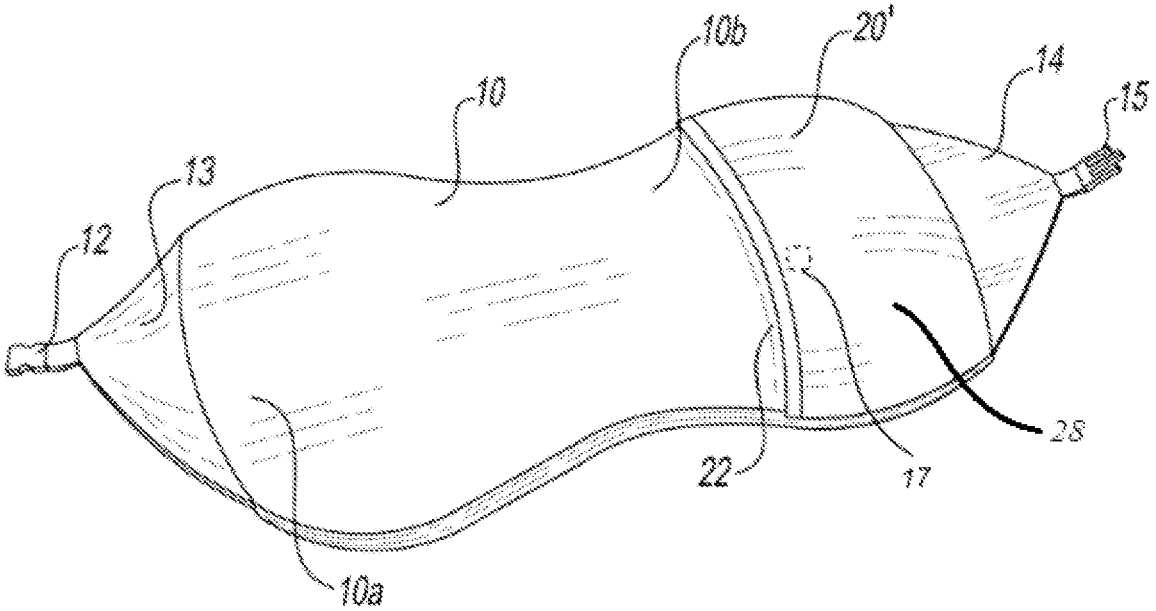
FIG. 4 shows a multifunctional pillow in an open position with a storage bag in accordance with another embodiment of the present application, the storage bag being in the form of a pocket disposed outside of and on the multifunctional pillow.
Figure 5:
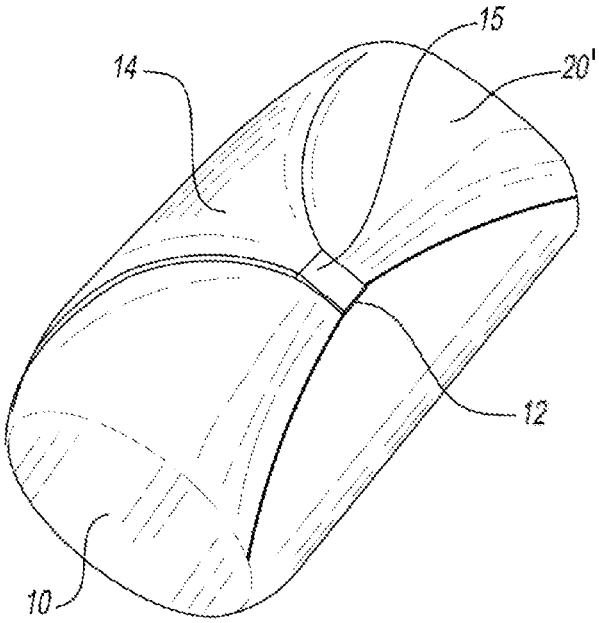
FIG. 5 shows the multifunctional pillow being stored in the storage bag in accordance with another embodiment of the present application.
Figure 6:
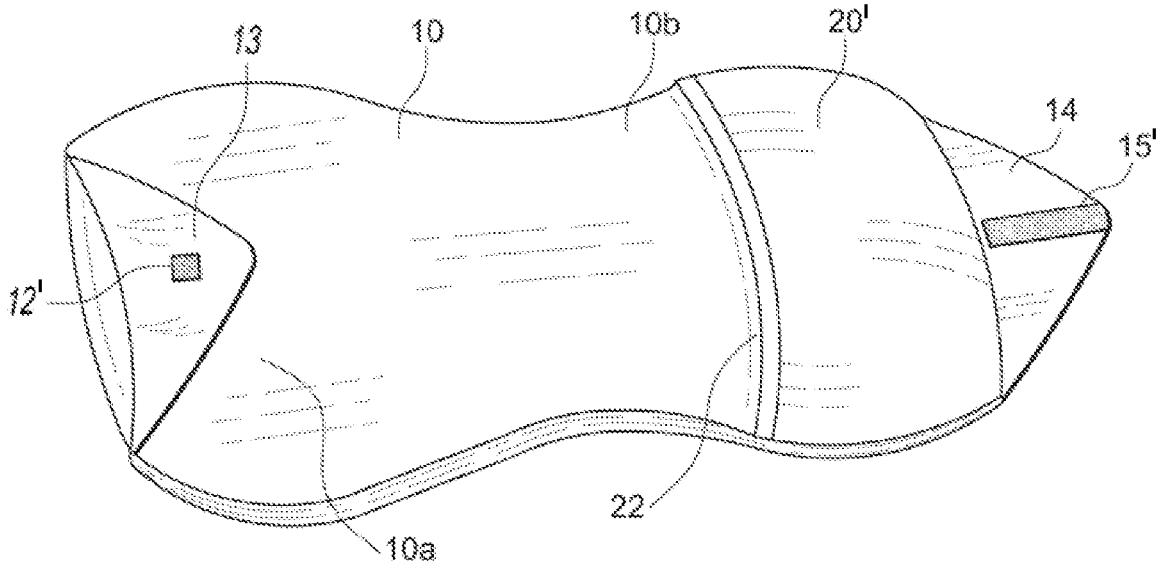
FIG. 6 shows a multifunctional pillow in an open position with hook and loop strap connectors and a storage bag in accordance with another embodiment of the present application, the storage bag being in the form of a pocket and disposed outside of and on the multifunctional pillow.

In another embodiment, as shown in FIGS. 4-6, the storage bag may be in the form of a pocket 20'. By definition, a pocket is a small bag. The pocket 20' is defined by a piece of fabric 28 with periphery being attached on the top face 10*e* of the pillowcase 10 at the second end 10*b* thereof, and formed a pocket opening 22 facing the first end 10*a* of the pillowcase 10 and extending between the two opposing sides 10*c*, 10*d*. The pocket 20' may be made of the same material as the pillowcase 10 or a similar material.

Similar to the previous embodiment, the pillow 8 may include a first connection part 13 connected to the first end 10*a* of the pillowcase 10, a second connection part 14 connected to the second end 10*b* of the pillowcase 10, a first connector 12 connected to the first connection part 13, and a second connector 15 connected to the second connection part 14. The first and second connection parts 13, 14 may have a triangular shape or another shape, and may be made of the same material or a similar material as the pillowcase 10.

The first connector 12 can be releasably fastened to the second connector 15. The first and second connectors 12, 15 may be in the form of a fastening mechanism such as a button, a buckle, or hook and loop straps. As illustrated in FIG. 6, the first and second connectors 12', 15' are hook and loop straps.

In another embodiment, a third connector 17 may be provided on an inner surface of the piece of fabric 28 proximate to the pocket opening 22, whereby the second connector 15 can be releasable fastened to the third connector 17, after the rolled up pillow is inserted into the pocket 20'. The third connector 17 can also be a buckle, a button, a hook/loop strap, etc.

To store the pillow 8 in the pocket 20', a user will roll the pillow 8 starting from the first end 10*a*, and place the rolled up pillow into the pocket 20'. The user will then connect the second connector 15 and the third connector 17 to secure the rolled up pillow, as shown in FIG. 5.

Figure 11:
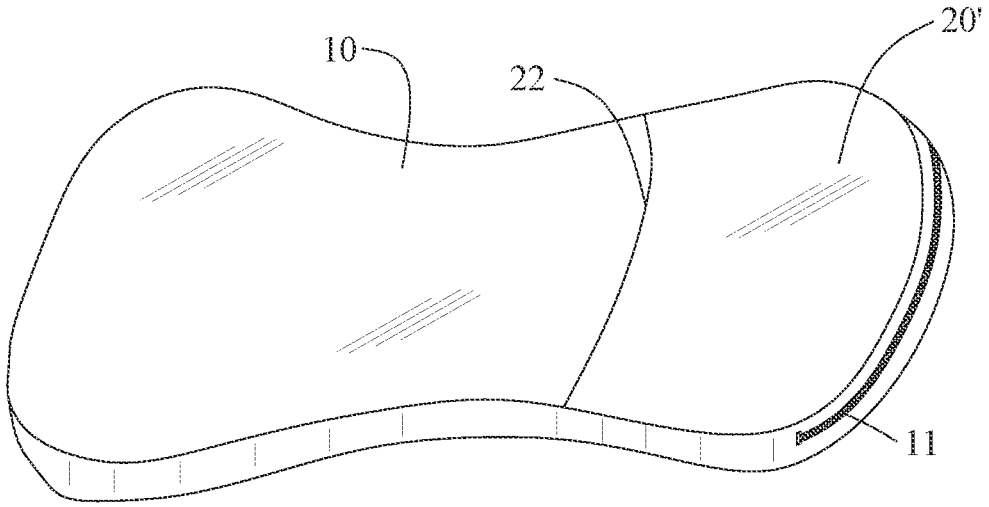
FIG. 11 shows the multifunctional pillow provided with a pocket according to an embodiment of the present application.

In yet another embodiment, as illustrated in FIG. 11, the pillow 8 is not provided with the first and second connection parts 13, 14, and the first and second connectors 12, 15.

Figure 8:
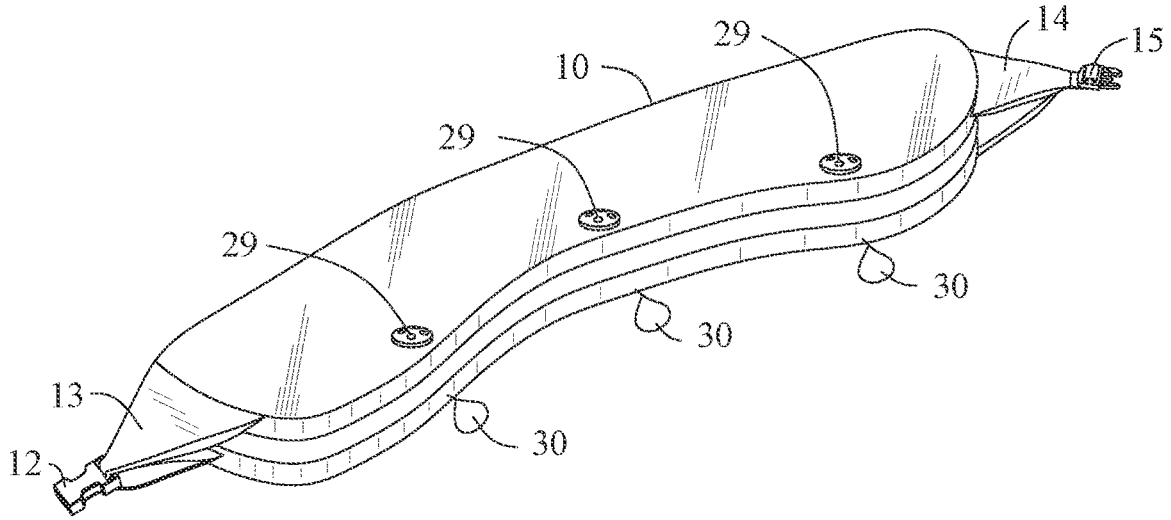
FIG. 8 shows the multifunctional pillow in a wrist rest pillow configuration.

The pillow 8 may be foldable along a longitudinal axis X extending between the first end 10*a* and the second end 10*b* of the pillowcase 10 to form a wrist rest pillow configuration, as shown in FIG. 8. One of the two opposing sides 10*c*, 10*d* may be provided with a plurality of first fasteners 29, and another one of the two opposing sides 10*c*, 10*d* may be provided with a plurality of second fasteners 30. The plurality of first fasteners 29 can be releasably fastenable to the plurality of second fasteners 30, thereby holding the pillow in the folded configuration. In the illustrated embodiment, the first fasteners 29 are buttons and the second fasteners 30 are loops for looping onto the buttons.

Figure 9:
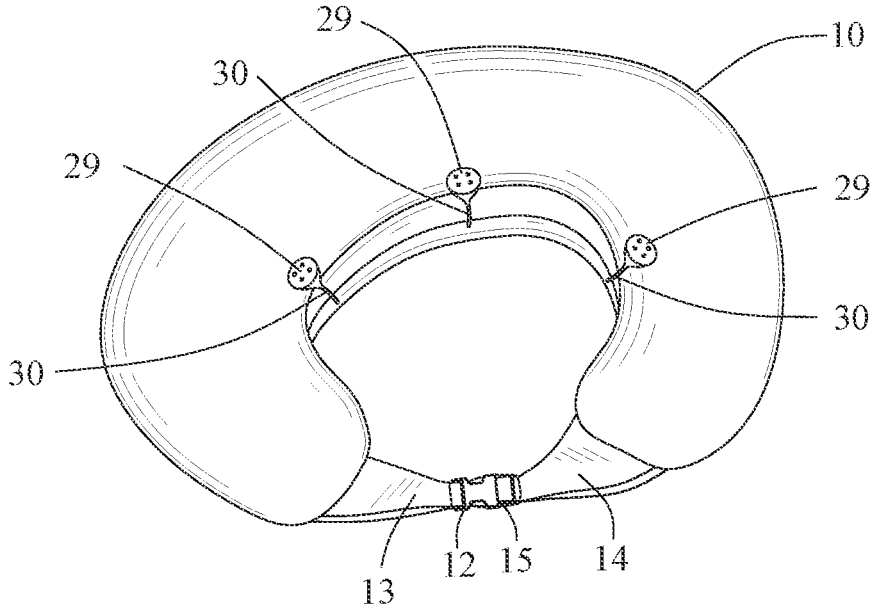
FIG. 9 shows the multifunctional pillow in a U-shaped neck pillow configuration.

The folded pillow may be further bendable into a U-shape, and the first connector 12 can be releasably fastened to the second connector 15 to form a neck pillow configuration, as shown in FIG. 9.

The two opposite sides 10*c*, 10*d* of the multifunctional pillow (the sides between the first end 10*a* and the second end 10*b*) may have an inwardly-curved arc shape. When a user bends the pillow or connects the first and second connectors 12, 15, the pillow becomes a U-shaped neck pillow, which can support the user's neck and provide comfort. In the U-shaped neck pillow configuration, the flexible bag 20 functions as a protection sheet that prevents the first connector 12 and the second connector 15 from touching a user when the first connector 12 and the second connector 15 are connected.

Figure 13:
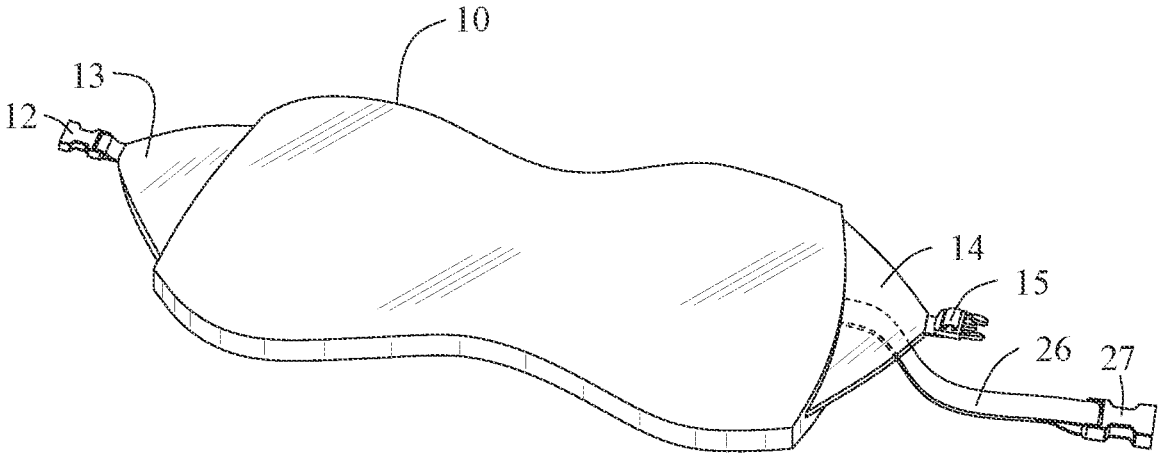
FIG. 13 shows the multifunctional pillow provided with a strap and a fourth connector according to an embodiment of the present application.

In one embodiment, as depicted in FIG. 13, the pillow 8 may include a first connection part 13 connected to the first end 10*a* of the pillowcase 10, a second connection part 14 connected to the second end 10*b* of the pillowcase 10, a first connector 12 connected to the first connection part 13, and a second connector 15 connected to the second connection part 14. The first connector 12 can be releasably fastened to the second connector 15. The pillow may further include a strap 26 having a proximal end connected to the second end 10*b* of the pillowcase 10, and a distal end connected to a fourth connector 27. The strap 26 is adapted to wrap around the rolled up pillow, and the fourth connector 27 is releasably fastened to the second connector 15, thereby holding the rolled up pillow in place.

Figure 12:
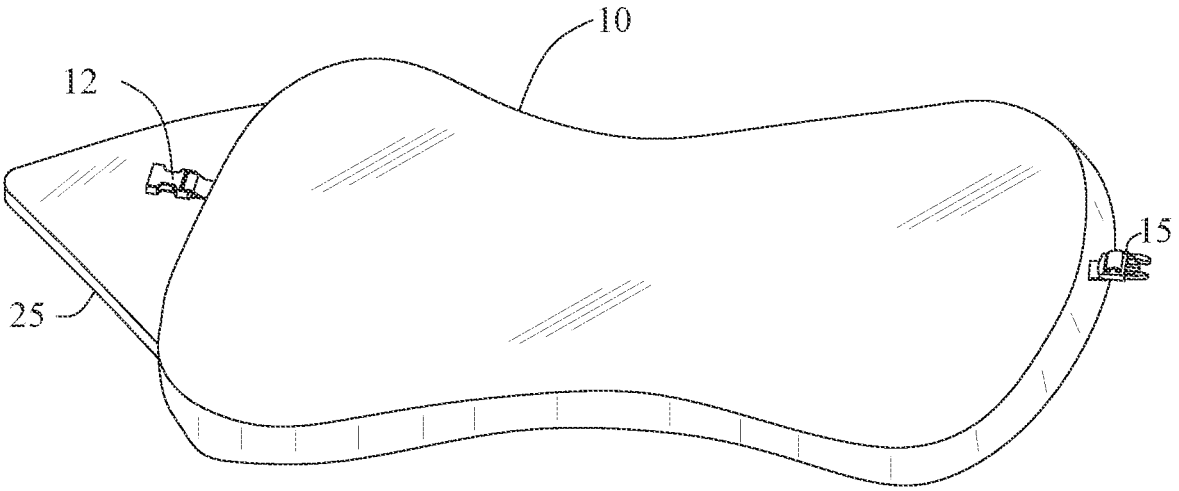
FIG. 12 shows the multifunctional pillow provided with a first connector, a second connector and a protection sheet according to an embodiment of the present application.

In a further embodiment, as shown in FIG. 12, the first connector 12 can be directly connected to the first end 10*a* of the pillowcase 10, and the second connector 15 can be directly connected to the second end 10*b* of the pillowcase 10. In use, the first connector 12 can be releasably fastened to the second connector 15. As illustrated in FIG. 12, a protection sheet 25 may be connected to the first end 10*a* of the pillowcase 10, and covered one side of the first connector 12, thereby preventing the first and second connectors 12, 15 from direct contact with a user's skin when the pillow is in use.

The pillow 8 of the present invention can have multiple functions. When it is in an open position (FIGS. 1, 2, and 4), the pillow can be used as a regular pillow for support a user's head. When the pillow is bent and the first connector 12 and the second connector 15 are connected, the pillow can be used as a U-shaped neck pillow for supporting a user's neck. When the pillow is folded along the longitudinal axis X, the pillow can be used as a waist pillow (FIG. 8). When the rolled up pillow is stored in the flexible bag 20 or the pocket 20', the pillow can easily be carried or stored, and can be used as a waist pillow.

The pillow of the present application has the following advantages. The pillow may be made of a soft material, and can be rolled up. The pillow includes a storage bag, and the pillow can be stored in the storage bag. The long sides of the multifunctional pillow have an inwardly-curved arc shape, and the pillow has a peanut shape. The pillow can be used as a regular pillow, neck pillow, or waist pillow.

It will be apparent to those skilled in the art that various modifications and variations can be made in the present invention without departing from the spirit or scope of the invention. Thus, it is intended that the present invention covers the modifications and variations of this invention provided that those modifications and variations come within the scope of the appended claims and their equivalents.

What is claimed is:

1. A multifunctional pillow comprising:

a flexible pillowcase, the pillowcase having a first end, an opposite second end, two opposing sides, a top face and a bottom face;

a pillow body provided inside the pillowcase, the pillow body being made of a soft material; and a storage bag attached to and provided at the second end of the pillowcase, wherein the pillow is rollable from the first end towards the second end, and the rolled up pillow is insertable into the storage bag, which is sized and shaped to fittingly hold the rolled up pillow;

wherein the storage bag is in the form of a flexible bag, the second end of the pillowcase is an open end, and the flexible bag is attached to the open end of the pillowcase and is sandwiched between the pillowcase and the pillow body when the flexible bag is not in use, and when in use, the rolled up pillow is inserted into the flexible bag after the flexible bag is pulled out from the pillowcase and turned inside-out, and formed into a waist pillow configuration.

2. The multifunctional pillow according to claim 1, further comprising a first connector connected to the first end of the pillowcase; and a second connector connected to the second end of the pillowcase, the first connector being releasably fastenable to the second connector.

3. The multifunctional pillow according to claim 2, wherein the releasably fastenable first and second connectors comprise a fastening mechanism selected from a group consisting of a button, a buckle, and hook and loop straps.

4. The multifunctional pillow according to claim 1, further comprising a first connection part connected to the first end of the pillowcase;

a second connection part connected to the second end of the pillowcase;

a first connector connected to the first connection part; and a second connector connected to the second connection part, the first connector being releasably fastenable to the second connector.

5. The multifunctional pillow according to claim 4, wherein the pillow is foldable along a longitudinal axis extending between the first end and the second end of the pillowcase to form a wrist rest pillow configuration.

6. The multifunctional pillow according to claim 5, wherein the folded pillow is further bendable into a U-shape, and the first connector is releasably fastenable to the second connector to form a neck pillow configuration.

7. The multifunctional pillow according to claim 5, wherein one of the two opposing sides is provided with a plurality of first fasteners, and another one of the two opposing sides is provided with a plurality of second fasteners, the plurality of first fasteners is releasably fastenable to the plurality of second fasteners, so as to hold the pillow in a folded configuration.

8. The multifunctional pillow according to claim 4, further comprising a strap having a proximal end connected to the second end of the pillowcase, and a distal end connected to a fourth connector, wherein the strap is adapted to wrap around the rolled up pillow, and the fourth connector is releasably fastened to the second connector, thereby holding the rolled up pillow in place.

9. The multifunctional pillow according to claim 1, further comprising a first connection part connected to the first end of the pillowcase;

a second connection part connected to the second end of the pillowcase;

a first connector connected to the first connection part; and a second connector connected to the second connection part, the first connector being releasably fastenable to the second connector.

10. The multifunctional pillow according to claim 1, wherein the flexible bag comprises a first closing element that opens and closes an opening of the flexible bag.

11. The multifunctional pillow according to claim 1, wherein the pillowcase comprises a second closing element that opens and closes the open end of the pillowcase.

12. The multifunctional pillow according to claim 1, wherein the soft material is a material selected from a group consisting of foam, chemical fiber, feather, silk and beads.

13. The multifunctional pillow according to claim 1, wherein the two opposing sides of the pillowcase have an inwardly-curved arc shape.

14. The multifunctional pillow according to claim 1, wherein the storage bag comprises a handle.

15. The multifunctional pillow according to claim 14, wherein the handle comprises a button, a buckle, or hook and loop straps.

16. A multifunctional pillow comprising:

a flexible pillowcase, the pillowcase having a first end, an opposite second end, two opposing sides, a top face and a bottom face;

a pillow body provided inside the pillowcase, the pillow body being made of a soft material; and a storage bag attached to and provided at the second end of the pillowcase, wherein the pillow is rollable from the first end towards the second end, and the rolled up pillow is insertable into the storage bag, which is sized and shaped to fittingly hold the rolled up pillow, wherein the storage bag is in the form of a pocket, the pocket is defined by a piece of fabric with periphery being attached on the top face of the pillowcase at the second end thereof, and formed a pocket opening facing the first end of the pillowcase and extending between the two opposing sides;

wherein the pillow further comprises:

a first connection part connected to the first end of the pillowcase;

a second connection part connected to the second end of the pillowcase;

a first connector connected to the first connection part; and a second connector connected to the second connection part, the first connector being releasably fastenable to the second connector.

17. The multifunctional pillow according to claim 16, further comprising a third connector provided on an inner surface of the piece of fabric proximate to the pocket opening, whereby the second connector is releasable fastenable to the third connector, after the rolled up pillow is inserted into the pocket.

18. A multifunctional pillow comprising:

a flexible pillowcase, the pillowcase having a first end, an opposite second end, two opposing sides, a top face and a bottom face;

a pillow body provided inside the pillowcase, the pillow body being made of a soft material; and a storage bag attached to and provided at the second end of the pillowcase, wherein the pillow is rollable from the first end towards the second end, and the rolled up pillow is insertable into the storage bag, which is sized and shaped to fittingly hold the rolled up pillow, further comprising a first connector connected to the first end of the pillowcase; and a second connector connected to the second end of the pillowcase, the first connector being releasably fastenable to the second connector;

further comprising a protection sheet connected to the first end of the pillowcase, and covering one side of the first connector, thereby preventing the first and second connectors from direct contact with a user's skin when the pillow is in use.

* * * * *